US009882331B2

(12) United States Patent
Winkler et al.

(10) Patent No.: US 9,882,331 B2
(45) Date of Patent: Jan. 30, 2018

(54) LOW COST GOLD WIRE BRUSHES

(71) Applicant: Schleifring and Apparatebau GmbH, Fürstenfeldbruck (DE)

(72) Inventors: Max Winkler, Germering (DE); Christian Holzapfel, Fürstenfeldbruck (DE)

(73) Assignee: SCHLEIFRING AND APPARATEBAU GMBH, Furstenfeldbruck (DE)

( * ) Notice: Subject to any disclaimer, the term of this patent is extended or adjusted under 35 U.S.C. 154(b) by 128 days.

(21) Appl. No.: 13/960,116

(22) Filed: Aug. 6, 2013

(65) Prior Publication Data

US 2014/0038434 A1 Feb. 6, 2014

(30) Foreign Application Priority Data

Aug. 6, 2012 (EP) ..... 12179432

(51) Int. Cl.

| | |
|---|---|
| ***H01R 39/24*** | (2006.01) |
| ***H01R 39/20*** | (2006.01) |
| ***H01R 43/12*** | (2006.01) |
| *H01R 13/33* | (2006.01) |

(52) U.S. Cl.

CPC ..... *H01R 39/24* (2013.01); *H01R 39/20* (2013.01); *H01R 43/12* (2013.01); *H01R 13/33* (2013.01)

(58) Field of Classification Search

CPC ..... H02K 5/145; H01R 39/24; H01R 39/025; H01R 39/20

See application file for complete search history.

(56) References Cited

U.S. PATENT DOCUMENTS

| | | | | |
|---|---|---|---|---|
| 3,041,118 | A * | 6/1962 | Campbell | H01H 11/045 200/283 |
| 4,163,916 | A * | 8/1979 | Kobayashi | 310/246 |
| 4,447,752 | A * | 5/1984 | Boyce | H01R 39/24 310/232 |
| 5,795,065 | A | 8/1998 | Barham | 374/106 |
| 5,814,915 | A | 9/1998 | Wang | 310/242 |
| 5,825,114 | A | 10/1998 | Mukai | 310/251 |
| 6,124,660 | A * | 9/2000 | Umeda | H02K 1/243 310/201 |

(Continued)

FOREIGN PATENT DOCUMENTS

| | | |
|---|---|---|
| CN | 1160302 | 9/1997 |
| CN | 101147309 A | 3/2008 |

(Continued)

OTHER PUBLICATIONS

Office Action in European Application No. 12 179 432.5 dated Sep. 2, 2014.

(Continued)

*Primary Examiner* — Dang Le

(74) *Attorney, Agent, or Firm* — Norton Rose Fulbright US LLP

(57) ABSTRACT

A slipring brush includes a body of a metal wire or metal band having a contact area for contacting a slipring module. The contact area is selectively coated by a contact material like gold or silver or an alloy thereof. The body preferably includes Copper, Nickel, Iron, or an alloy thereof. Coating may be done by electroplating, physical vapor deposition (PVD) or chemical vapor deposition (CVD).

14 Claims, 5 Drawing Sheets

(56) References Cited

U.S. PATENT DOCUMENTS

| | | | | |
|---|---|---|---|---|
| 6,710,496 | B2 * | 3/2004 | Fujita | H02K 15/0478 310/201 |
| 7,774,935 | B2 * | 8/2010 | Barbet | H01R 39/39 29/854 |
| 2008/0012446 | A1 * | 1/2008 | Akabane | 310/233 |

FOREIGN PATENT DOCUMENTS

| | | |
|---|---|---|
| EP | 0054380 | 6/1982 |
| EP | 1 124 288 A1 | 8/2001 |

OTHER PUBLICATIONS

Office Action in Chinese Application No. 201310337972.5 dated Feb. 3, 2016.

* cited by examiner

LOW COST GOLD WIRE BRUSHES

PRIORITY CLAIM

This application claims priority to pending European Patent Application No. 12179432.5 filed on 6 Aug. 2012.

BACKGROUND OF THE INVENTION

1. Field of the Invention

The invention relates to an electrical power transfer device like a slipring or rotary joint and brushes thereof. Sliprings are used to transfer electrical power between rotating parts of machines like wind power plants, CT scanners or electrical generators. There a brush, mainly including electrically conductive material like a metal is sliding on a rotating cylindrical track of conductive material like brass, which may have gold plating.

2. Description of Related Art

The European patent application EP 0054380 A1 discloses a slip ring and brush assembly. The brush includes a bundle of thin electrically conducting fibers, which project from a brush holder to contact the slipring. The annular contact surface of the slipring is provided by a gold layer thereon. By making the fibers of a material harder than the gold layer, transfer of gold from that layer to the contacting regions of the fibers during an initial period of use can be encouraged, thereby to improve the subsequent operating characteristics. The disadvantage is comparatively poor electrical characteristics when the brushes are new. When a brush slightly varies its position or orientation, the electrical characteristics are again poor until a gold layer has been established at the new contact point on the surface of the brush.

In the European patent application EP 317 030 A2 a further slipring assembly is disclosed. Here the brushes are wire springs including gold. In an alternative embodiment, the wire springs are of a metal baser than gold and the free ends have a sleeve of gold. The solutions provided herein are comparatively expensive. The wire spring of solid gold requires a large amount of gold, while a sleeve of gold is difficult to manufacture and difficult to apply to the end of the wire spring. Furthermore, the sleeve may be pulled of the end of the wire spring, which results in a complete loss of transmission characteristics.

SUMMARY OF THE INVENTION

The embodiments are based on the object of providing slipring brushes and a slipring with simplified manufacturing and reducing manufacturing costs, while maintaining a high degree of reliability, a high lifetime and the high transmission quality.

In an embodiment, the slipring brushes are based on a body of metal wire or metal band, which provides an electrical conductivity for conducting the required current. It furthermore provides certain mechanical properties like elasticity, which are required for a slipring brush. Generally, the body material has good spring properties and/or good thermal conductivity and/or good electrical conductivity. Preferred body materials are copper (Cu), nickel (Ni) or iron (Fe) alloys. To provide a low resistance and long lasting reliable contact between the slipring brush and a slipring module, sections of the slipring brushes, which establish a sliding contact with a slipring module are coated or plated, preferably electroplated with a specific contact material providing long-lasting and reliable contact. Generally, a contact material should be tribologically favorable and it preferably offers a low contact resistance. A tribologically favorable contact exhibits a low overall wear rate of the system. The wear rate here describes the total mass loss of brush and track as a function of time. For the proposed selectively coated or plated system the individual wear rate of the coating of the brush should also be lower than the corresponding wear rate of the track hence ensuring that the coating thickness is not life-time limiting. A favorable system can usually be achieved if the hardness of the coating of the brush is higher as the counter body. In addition, a friction coefficient <0.5 is especially favorable for non-lubricated systems. In the case of lubricated systems, a favorable value would be <0.2. Preferably, the contact material is gold (Au), silver (Ag), platinum (Pt), palladium (Pd), rhodium (Rh), any other noble metal, or any alloy thereof. It is preferred, if the contact material has a bigger hardness (Vickers hardness) than the slip ring track it is intended to run on. This results in the largest possible lifetime. Preferably, the contact material is nobler than the body material. Most preferably, a slipring brush includes of a metal wire having at least one section, preferably one end coated or plated with a contact material, preferably gold. It is further preferred to have double brushes, where both ends of the wire are coated or plated with a contact material.

A further embodiment relates to a brush block having a brush holder and at least one brush as disclosed herein.

In another embodiment, a slipring assembly has a slipring module and at least one brush block as described herein.

A further embodiment relates to a first method of producing slipring brushes. A metal wire or metal band is cut to pieces of required length. After cutting at least one end, preferably both ends are coated or plated by a contact material. There may be an additional step of bending the brush before or after coating. Another embodiment relates to a second method of producing slipring brushes. This is a continuous method. Herein a continuous wire or metal band or at least pieces of such a wire or metal band having the length of a plurality of slipring brushes are processed. Predetermined sections of the wire or metal band are coated or plated by using at least one electrode pad. After coating, the wire or metal band is cut into pieces and bent into the required form.

In a preferred embodiment, coating is done by electroplating.

In another embodiment, coating is done by physical vapor deposition (PVD) which may include any method to deposit a thin film by the condensation of a vaporized form of the film material onto the surface of the wire or metal band.

According to a further embodiment, coating is done by chemical vapor deposition (CVD) which may include any chemical reaction or decomposition of at least one precursor to form a film onto the surface of the wire or metal band.

BRIEF DESCRIPTION OF THE DRAWINGS

In the following, the invention will be described by way of example, without limitation of the general inventive concept, on examples of embodiment and with reference to the drawings.

Figure 1:
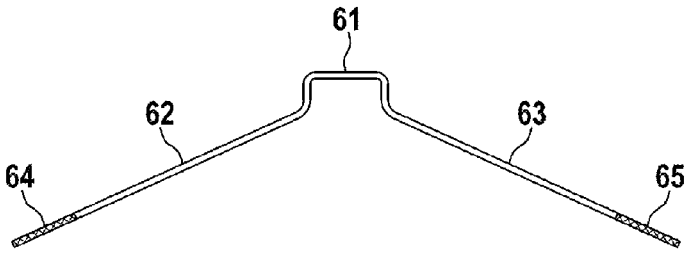
FIG. 1 shows a first slipring brush.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF ILLUSTRATIVE EMBODIMENTS

In FIG. 1, a preferred embodiment according to the invention is shown. A slipring brush has a center section 61, which may be bent to be adapted to a brush holder. On the first side of this center section is a first uncoated section 62 followed by a first coated or plated section 64, and on the second side of the center section is a second uncoated section 63 followed by a second coated or plated section 65. The first and second coated or plated sections are the sections, which are in contact with a slipring module. Contact of the uncoated section with a slipring module should be avoided, as this could cause unnecessary wear and results in poor transmission characteristics like considerably contact noise. Preferably, the coating completely encloses the coated or plated sections. Details of the coated or plated sections are shown in the next figure.

Figure 2:
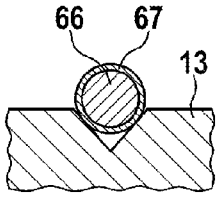
FIG. 2 shows details of a coated or plated section.

In FIG. 2, the details of a coated or plated section are shown. A wire 66 has a coated or plated surface section 67. The wire is running on a slip ring track 13, which preferably has a V-groove. The coated or plated surface, which preferably has been made by electroplating, is radially surrounding the wire 66, even if the wire contacts the slip ring track at one or two points of the V-groove only.

Figure 3:
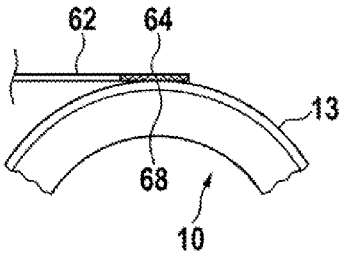
FIG. 3 shows a side view of the coated or plated section.

In FIG. 3, a side view of a coated or plated section is shown. The coated or plated section 64 is in contact with slipring track 13 at contact point 68. The coated or plated section extends somewhat to both sides of the contact point to ensure a contact between the coated or plated section and the slipring track even under various operating conditions and to compensate for mechanical tolerances. The total length of the coated or plated section preferably is in a range between 5 mm to 40 mm, most preferably between 10 and 20 mm.

Figure 4:
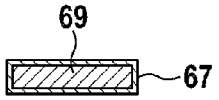
FIG. 4 shows a different embodiment of a slipring brush.

In FIG. 4, a different embodiment based on the metal band is shown. Here the slipring brush is based on a metal band 69, which has a coated or plated section 67 as described before.

Figure 5:
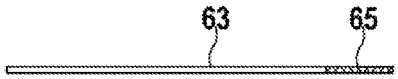
FIG. 5 shows another embodiment.

In FIG. 5, another embodiment with a single brush is shown. The brush includes a first uncoated or plated section 63 and a first coated or plated section 65 at one end. The other end is uncoated and preferably is used to hold and/or to contact the brush.

Figure 6:
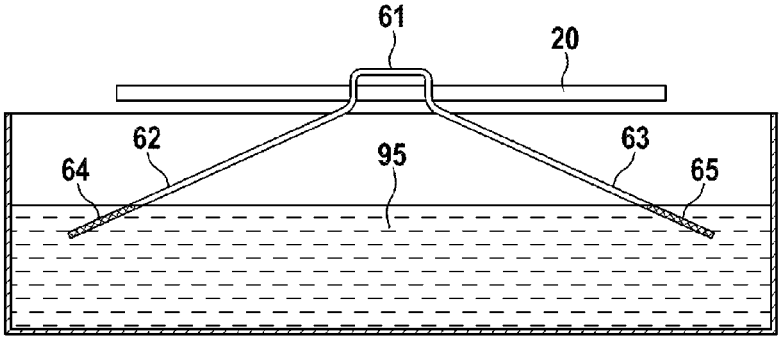
FIG. 6 shows processing of the slipring brush in a brush holder.

In FIG. 6, a slipring brush according to a first embodiment is shown assembled into a brush holder 20. Furthermore, a process of electroplating is illustrated. Here the brush is dipped into a galvanic fluid 95. The depth of dipping the brush into the fluid defines the length of coating. Here the brush holder may have at least one of an electrical contact, connector, connecting cable, which may be used to supply the current required for electroplating.

Figure 7:
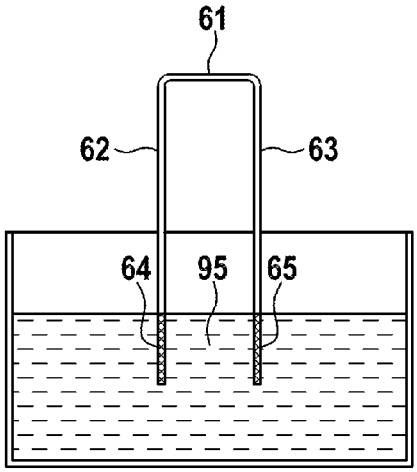
FIG. 7 shows processing of a slipring brush.

In FIG. 7, another slipring brush is shown being dipped into a galvanic fluid 95. This slipring brush may be inserted into a brush holder 20. After insertion, the sections of the slipring brush may be bent outwards to obtain a form as shown in the figure above.

Figure 8:
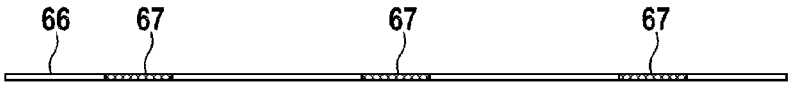
FIG. 8 shows a further embodiment.
Figure 9:
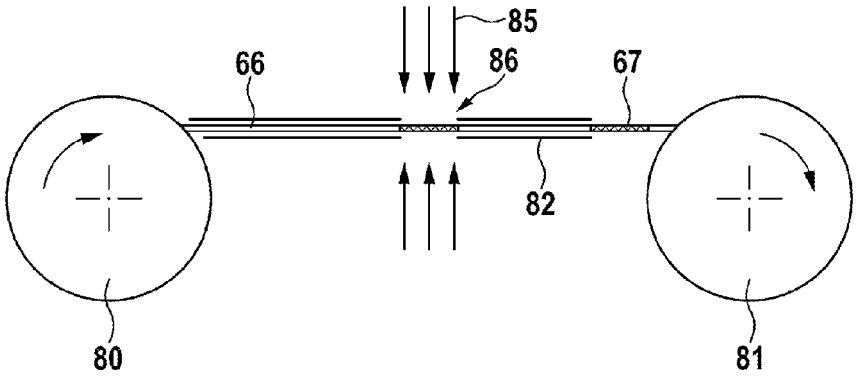
FIG. 9 shows the concept of PVD or CVD processing.

In FIG. 8, a further embodiment is shown. Herein a continuous wire 66 or metal band or at least pieces of such a wire or metal band having the length of a plurality of slipring brushes are processed. Predetermined sections 67 of the wire or metal band are electroplated by using at least one electrode pad. After electroplating, the wire or metal band is cut into pieces and bent into the required form.

Figure nine the basic concept of PVD and CVD coating is shown. Preferably, this is combined with a continuous process. As an alternative, it may be done with batches of individual wires or metal bands. There may be a first reel delivering and uncoated wire or metal band, which preferably is fed through a mask 82, which has an opening 86 for the area to be coated or plated. This area may either be exposed to a plasma 85, a gas or any precursor or any other means or medium required for PVD or CVD processing. Furthermore, this area may be within a vacuum chamber. There may be another reel 81 for winding up the processed wire or metal band.

Figure 10:
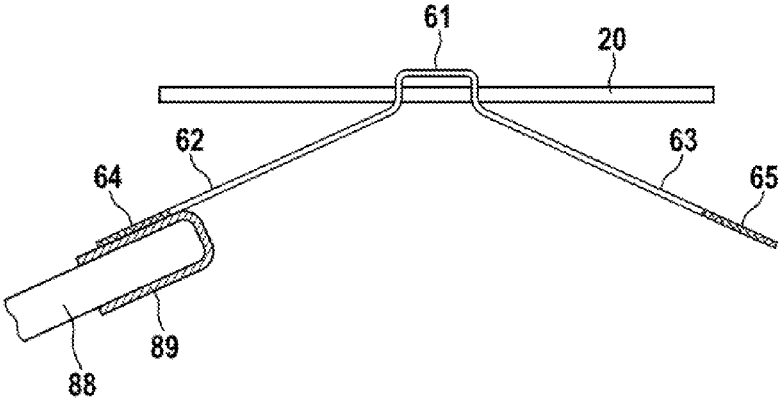
FIG. 10 shows electroplating by means of a pad.
Figure 12:
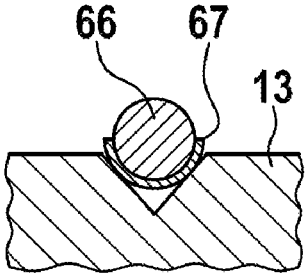
FIG. 12 shows a sectionally selectively coated or plated brush.

In FIG. 10, electroplating by means of a pad is shown. A brush may be held by a fixture or preferably may be assembled into a brush holder. For electroplating an electrode 88, having a pad 89 may be used Preferably, the pad 89 is impregnated with a galvanic fluid. Preferably, the electrode and the brush are connected to a current source. The electrode and/or the pad are positioned at a location of the brush, preferably at the end of the brush, where coating or electroplating is desired to produce a coating of the brush. Preferably the electrode and/or the pad are positioned in a similar position as a slipring would have later, resulting in electroplating of the region of the brush which will be in close contact to the slipring module later. Preferably the opposing side of the wire of the brush is not electroplated which further leads to a reduction in cost. Such a brush is shown in FIG. 12. It is further preferred, if a plurality of brushes are assembled to common holder and it is further preferred, if there is a common pad for contacting most of the brushes, preferably all brushes at the same time.

Figure 11:
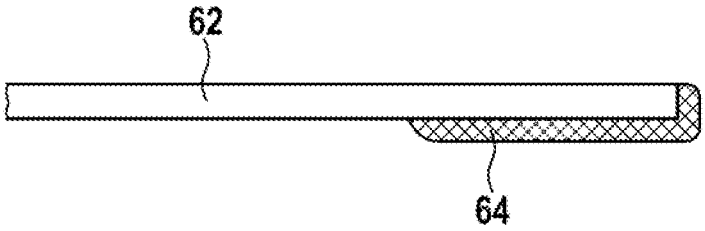
FIG. 11 shows a selectively coated or plated brush.

In FIG. 11, a selectively coated or plated brush is shown. Here the first coated or plated section 64 covers only a part of the brush, preferably the part that will be in contact with the slipring module later. The coated or plated section may be at any position of the brush; it preferably extends to an end, most preferably the end distant of the brush holder.

In FIG. 12, an alternative embodiment is shown. Only a part of the circumference is coated or plated. More general, of a cross section of a brush (which may be a section at a right angle to a lateral axis of the brush), only a part is coated or plated. Most preferably, the side oriented towards the slip ring module is coated or plated. In this embodiment, the coated or plated surface section 67 only covers about half of the circumference. Preferably, it covers less than half of the circumference. In the case of a rectangular cross-sectioned brush, the coated or plated section may only cover some sides, preferably one side of the brush. In another alternative embodiment, the coated or plated section may only cover some sides, preferably one side of a flat brush.

Figure 13:
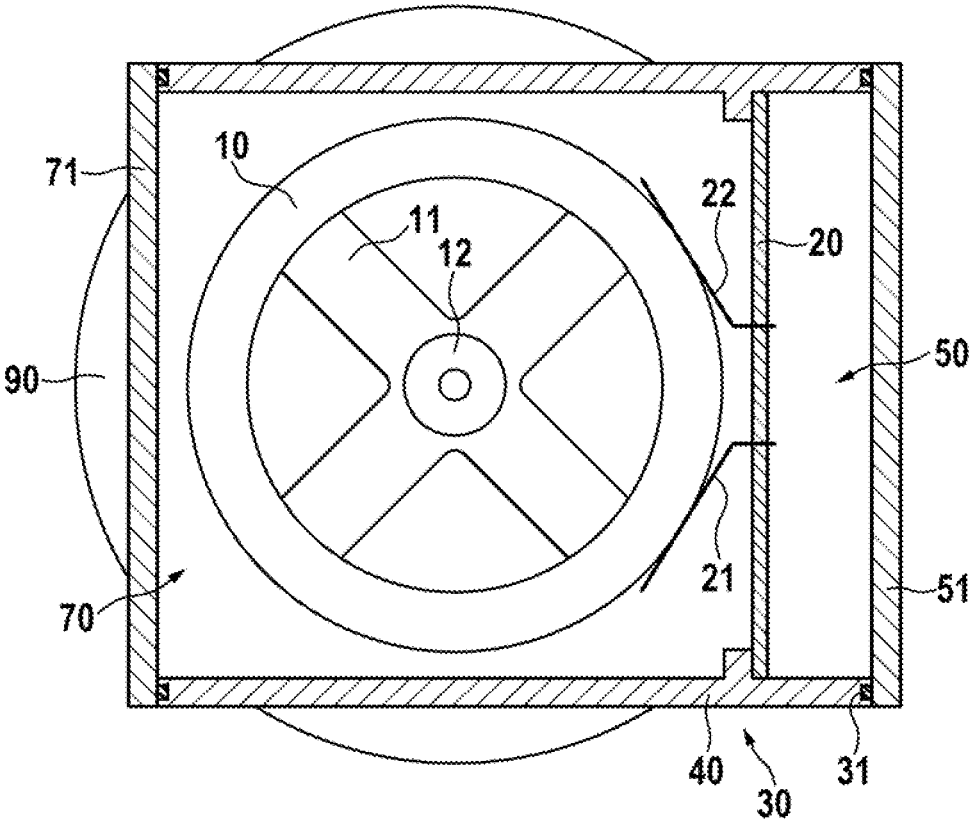
FIG. 13 shows a top view of a general slipring assembly.

In FIG. 13, a top view of the general slipring assembly is shown. A slipring module 10 is held by a module support 11 and mounted to a shaft 12. There is a plurality of contact brushes like first contact brush 21 and second contact brush 22, which are held and electrically contacted by brush holder 20. The slipring assembly is enclosed by a slipring housing 30 having a plurality of sidewalls 40. There may be a connecting space 50 for electrically connecting the slipring brushes, which may have a first cover 51. Furthermore, the inner space 70 of the housing has a second cover 71. Below the housing 30 is a housing of bearing 90.

It will be appreciated to those skilled in the art having the benefit of this disclosure that this invention is believed to provide rotary joints for transmitting electrical signals between rotating parts and brushes thereof. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

10 slipring module
11 module support
12 shaft
13 slipring track
20 brush holder
21 first brush
22 second brush
30 slipring housing
40 sidewall
50 connecting space
51 first cover
61 center section of slipring brush
62 first uncoated section
63 second uncoated section
64 first coated section
65 second coated section
66 wire
67 coating
68 contact point
69 metal band
70 inner space of housing
71 second cover
80 first reel
81 second reel
82 mask
85 plasma or gas
86 area to be processed
88 electrode
89 pad
90 housing of bearing
95 galvanic fluid

The invention claimed is:

1. A slipring brush comprising:

a body of a metal wire having a contact area for contacting a slipring module, wherein the contact area of the metal wire is electroplated with at least one contact material, and the metal wire is elongated and has a circular cross-section.

2. The Slipring brush according to claim 1, wherein the contact material is nobler than the material of the body.

3. The Slipring brush according to claim 1, wherein the contact material is tribologically favorable.

4. The Slipring brush according to claim 3, wherein the contact material has a low contact resistance.

5. The Slipring brush according to claim 1, wherein the contact material has a low contact resistance.

6. The Slipring brush according to claim 1, wherein the contact material includes gold, silver, platinum, palladium, rhodium, or an alloy thereof.

7. The Slipring brush according to claim 1, wherein the body material has at least one of: good spring properties, good thermal conductivity, and/or good electrical conductivity.

8. The Slipring brush according to claim 1, wherein the body material is one of copper, nickel or iron alloys.

9. A slipring brush block comprising at least one slipring brush according to claim 1.

10. A slipring assembly comprising at least one slipring brush block according to claim 9.

11. A method of manufacturing a slipring brush according to claim 1, comprising:

providing a body of a metal wire or metal band, and coating at least one section of the body.

12. The method of claim 11, further comprising:

coating at least one end of the body.

13. The method of claim 11, wherein coating includes at least one of electroplating, PVD, CVD or a combination thereof.

14. The method of claim 11, further including the additional step of: bending the slip ring brush.

* * * * *